United States Patent [19]

Kühnert et al.

[11] Patent Number: 4,526,018

[45] Date of Patent: Jul. 2, 1985

[54] KNITTING CAM UNIT AND TRANSFER CAM UNIT COMBINATION FOR V-BED FLAT KNITTING MACHINES WITH SLIDER NEEDLES

[75] Inventors: Gottfried Kühnert, Aalen; Albert Lutz, Westhausen, both of Fed. Rep. of Germany

[73] Assignee: Universal Maschinenfabrik Dr. Rudolf Schieber GmbH & Co. KG, Westhausen, Fed. Rep. of Germany

[21] Appl. No.: 497,453

[22] Filed: May 23, 1983

[30] Foreign Application Priority Data

May 27, 1982 [DE] Fed. Rep. of Germany ..... 3220049

[51] Int. Cl.[3] ..... D04B 7/00

[52] U.S. Cl. ..... 66/78; 66/70

[58] Field of Search ..... 66/78, 66, 67, 70

[56] References Cited

U.S. PATENT DOCUMENTS 4,287,727 9/1981 Otoshi ..... 66/78

*Primary Examiner*—Ronald Feldbaum

*Attorney, Agent, or Firm*—Sughrue, Mion, Zinn, Macpeak, and Seas

[57] ABSTRACT

A knitting cam unit and transfer cam unit combination for V-bed flat knitting machines wherein needle butts of the needle bodies of slider needles are selectively lowerable in the needle channels of the needle beds by means of a needle selection device, and wherein the slider needles have sliders provided with slider butts and arranged for the donation of stitches, comprises stationary and movable cam elements for engagement with the needle butts and the slider butts, and also comprises pressure cam elements. In order to be able to carry out any combination of stitch formation and tuck loop formation for each traverse of the carriage, and in order to be able to transfer any stitches, pure knitting cam units and transfer cam units are provided. These define cam channels for the butts arranged symmetrically with respect to each cam unit central transverse axis. Each knitting cam unit comprises a symmetrical cam element which is pivotable into operation to engage the needle butts in the formation of stitches, and each transfer cam unit comprises a symmetrical cam element to engage the needle butts in the donation of stitches and two movable cam elements arranged symmetrically relative to this cam element to engage the needle butts in the acceptance of stitches. Selection positions for the needle butts are provided for each knitting cam unit and transfer cam unit.

5 Claims, 7 Drawing Figures

S
S2
U2
1
2
3
4
5
6
7
8
9
10
11
13
14
15
16
17
18
20
22
23
24
25
26
27
28
29
30
31
32
33
45

KNITTING CAM UNIT AND TRANSFER CAM UNIT COMBINATION FOR V-BED FLAT KNITTING MACHINES WITH SLIDER NEEDLES

BACKGROUND TO THE INVENTION

This invention relates to a knitting cam unit and transfer cam unit combination for V-bed flat knitting machines, wherein needle butts of the needle bodies of slider needles are selectively lowerable in the needle channels of the needle beds by means of a needle selection device, wherein the slider needles have sliders provided with slider butts and arranged for the donation of stitches, wherein stationary and movable cam elements are provided for engagement with the needle butts and the slider butts, and wherein pressure cam elements are provided co-operating with the needle selection device.

A knitting-transfer cam unit comparable with such a cam unit combination is known for example from DE-OS 22 28 547. This known knitting-transfer cam unit comprises movable cam elements both for the needle butts and also for the slider butts, and makes possible, in one carriage traverse, the formation of stitches, the formation of tuck loops, the donation of stitches from the front needle bed to the rear needle bed or the donation of stitches from the rear needle bed to the front needle bed.

Cam units for knitting machines with latch needles are also known which are arranged adjacent to each other but only for knitting or only for stitch transfer. Furthermore, such cam units are known where the units are arranged below one another and operate with double-butt needles. A combined knitting-transfer-double cam unit for latch needles is also known by means of which one can only transfer stitches in one direction with the particular leading cam unit, for example stitches advancing from right to left forwards and stitches advancing from left to right rearwards.

SUMMARY OF THE INVENTION

It is an object of the present invention to provide a knitting cam unit and transfer cam unit combination of the type first referred to above by means of which for each carriage traverse, any combination of stitch formation and tuck loop formation can be carried out and any stitches can be transferred, i.e. independently of the direction of carriage traverse and independently of the transfer direction from the front rearwards, from the rear forwards or simultaneously in both directions.

This is achieved in accordance with the present invention by the following combination of features:

(a) at least one pure knitting cam unit and a leading and a trailing pure transfer cam unit are provided;

(b) cam channels for the needle butts and for the slider butts are defined by the respective cam units each channel being symmetrical with respect to the central transverse axis of each cam unit, (c) each knitting cam unit comprises a symmetrical cam element for striking the needle butts for the formation of stitches, the or each said cam element being tiltable into operation in the leading sense at the positions of carriage reversal, (d) each transfer cam unit comprises a symmetrical cam element for striking the needle butts for the donation of stitches and two cam elements arranged symmetrically with respect to this cam element for striking the needle butts for the acceptance of stitches, wherein the cam elements adjacent to the respective knitting cam units at the positions of carriage reversal, are movable in a pendular manner out of operation when trailing the knitting cam unit and are movable into operation when leading the knitting cam unit, (e) for each knitting cam unit there are two selection positions for the needle butts for the formation of stitches, and, at the central transverse axis, one selection position for the needle butts for the formation of tuck loops, and (f) for each transfer cam unit there are two selection positions for the needle butts for the donation of stitches or for the acceptance of stitches.

With this knitting cam unit and transfer cam unit combination all stitch-, tuck loop-, and no-knit combinations can be produced both forwards and backwards independently of the direction of traverse of the carriage, and stitches can be transferred from the front to the back, from the back to the front or simultaneously in both directions independently of the direction of traverse of the carriage and independently of the direction of transfer.

Preferably, the cam elements which strike the slider butts are stationary and are formed such that they define slider butt channels delimited on both sides for a relative movement between needle body and slider in the longitudinal direction of the slider. By this means one ensures a trouble-free movement of the sliders relative to the needle bodies with a simple cam structure.

Preferably, the cam elements which strike the needle butts for the donation of stitches are formed as elements which are pivotable by the needle butts. With this construction one achieves an additional shortening of the transfer cam units in their direction of travel.

In one preferred embodiment of the invention, the knitting cam unit and transfer cam unit combination is constructed so that two knitting cam units are arranged between the transfer cam units, and one of the two selection positions for the needle butts for the formation of stitches is common to the two knitting cam units and is arranged between them.

According to another embodiment of the invention, a plurality of knitting cam units are provided, and a further transfer cam unit is arranged between adjacent knitting cam units or adjacent double knitting cam units.

BRIEF DESCRIPTION OF THE DRAWINGS

The invention will now be more fully described with reference to certain preferred embodiments and in conjunction with the accompanying drawings. In the drawings.

DESCRIPTION OF THE PREFERRED EMBODIMENTS

Figure 1:
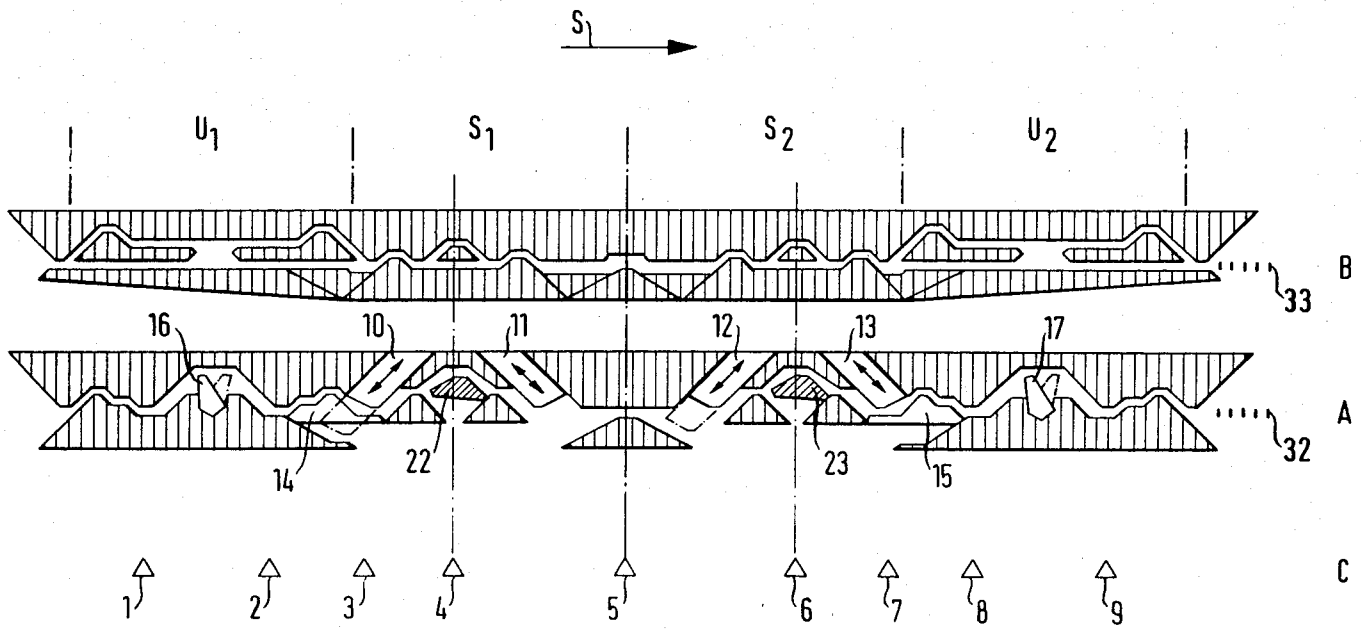
FIG. 1 shows an embodiment of a knitting cam unit and transfer cam unit combination for a needle bed of a flat knitting machine having two knitting cam units and two transfer cam units.

The embodiment of knitting cam and transfer cam combination for slider needles shown in FIGS. 1 to 4 is used for the control of the needle bodies and of the sliders of the slider needles in the formation of stitches and formation of tuck loops, as well as in the combination of both types of knitting in the three-way technique (stitch, tuck, no-knit), and in the donation and acceptance of stitches, or both simultaneously, during a course of knitting, i.e. with a traverse of the carriage from left to right or from right to left. The cam combination according to this embodiment comprises two purely knitting cam units $S_1$ and $S_2$ arranged adjacent to each other, as well as respective purely transfer cam units $U_1$, $U_2$, one leading and one trailing, which are formed as extensions one on each side of the knitting cam units $S_1$ and $S_2$. As occasion demands, one can alternatively provide just one knitting cam unit or a plurality of knitting cam units, with a further transfer cam unit arranged between adjacent knitting cam units or adjacent double knitting cam units as the case may be. Each cam unit has a cam zone A for the control of the needle bodies, a cam zone B for the control of the sliders of the slider needles, and a cam zone C for the selective choice of needles.

Cam channels for the needle butts in cam zone A and cam channels for the slider butts in cam zone B are each positioned symmetrically in relation to the central transverse axis of each cam unit. The needle selection is effected in such a way that the needle butts of the needles which are not intended to be operational are lowered in the needle bed. All stationary cam unit components which are not movable are indicated in the drawings with vertical cross-hatching. All movable cam elements are either shown without hatching (when moving out of operation) or are shown with diagonal hatching (when moving into operation). All the cam elements in cam zone B for the control of the sliders are stationary cam elements.

Nine selection positions 1, 2, 3, 4, 5, 6, 7, 8 and 9 are provided in cam zone C. In one traverse of the carriage from left to right in the direction of the arrow S in FIG. 1 selection positions 9 and 2 serve for the donation of stitches, selection positions 8 and 1 serve for the acceptance of stitches, selection positions 7 and 5 serve for the formation of stitches and selection positions 6 and 4 serve for the formation of tuck loops. With a traverse of the carriage from right to left in the opposite direction to that indicated by the arrow S in FIG. 1, selection positions 1 and 8 serve for the donation of stitches, selection positions 2 and 9 serve for the acceptance of stitches, selection positions 3 and 5 serve for the formation of stitches and selection positions 4 and 6 serve for the formation of tuck loops. It will be apparent from FIG. 1 without further explanation that for each knitting cam unit two selection positions 7 and 5 or 3 and 5 are provided for the needle butts for the formation of stitches, and near the central transverse axis, one selection position 6, 4 or 4, 6 is provided for the needle butts for the formation of tuck loops. Selection position 5 is common for both knitting cam units $S_1$ and $S_2$. It will also be appreciated from FIG. 1 that for each transfer cam unit two selection positions 9, 2 or 1, 8 are arranged for the needle butts for the donation of stitches or for the acceptance of stitches.

Cam elements 10, 11, 12 and 13 of the knitting cam units are triangular retractors which are displaceable in the direction of the double-headed arrows shown in the drawings. Cam elements 14 and 15 of the transfer cam units are formed so as to be lowerable. The trailing knitting cam units are always moved out of operation automatically at the positions of carriage reversal, and the leading knitting cam units can be moved into operation as needed. Before the movement of the cam elements 14 and 15 into operation the cam elements 10 and 13 of the knitting cam units must be swung upwards. Cam elements 16 and 17 of the transfer cam units are pivotable elements which, depending upon the direction of traverse of the carriage, are pivoted by the needle butts in the one direction or the other direction.

Figure 4:
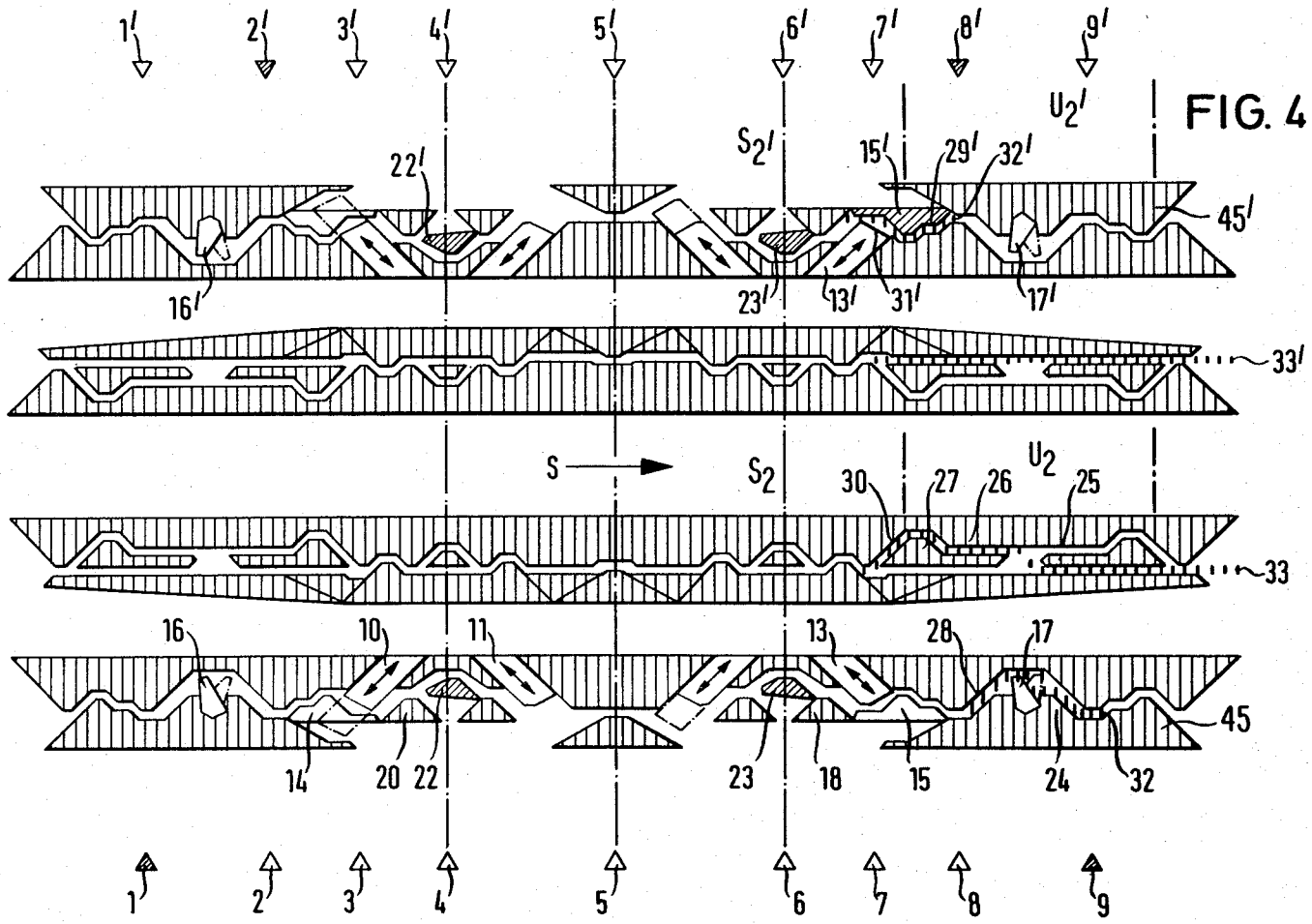
FIG. 4 shows the knitting and transfer cam unit combination of FIG. 1, for both needle beds, in which the leading transfer cam unit for the front needle bed and the trailing transfer cam unit for the rear needle bed are displaced to positions for the donation of stitches, and the leading transfer cam unit for the rear needle bed and the trailing transfer cam unit for the front needle bed are displaced into positions for the acceptance of stitches; and, FIGS. 5 to 7 show three different stages in the transfer of stitches from a donor slider to an accepting needle.

Cam elements 22 and 23 of the knitting cam units are symmetrical pivotable elements which, at the positions of carriage reversal, are automatically swung into operation in the leading sense in order to strike the needle butts for the formation of stitches. The needle butts of the slider needles are indicated at 32, and the slider butts of the sliders are indicated at 33. All corresponding cam elements of the cam units for the rear needle bed are indicated by the same reference numbers but with a prime'. (FIG. 4). Two cam elements 15, 15' and 45, 45' are arranged symmetrically with respect to cam elements 17, 17'.

Figure 2:
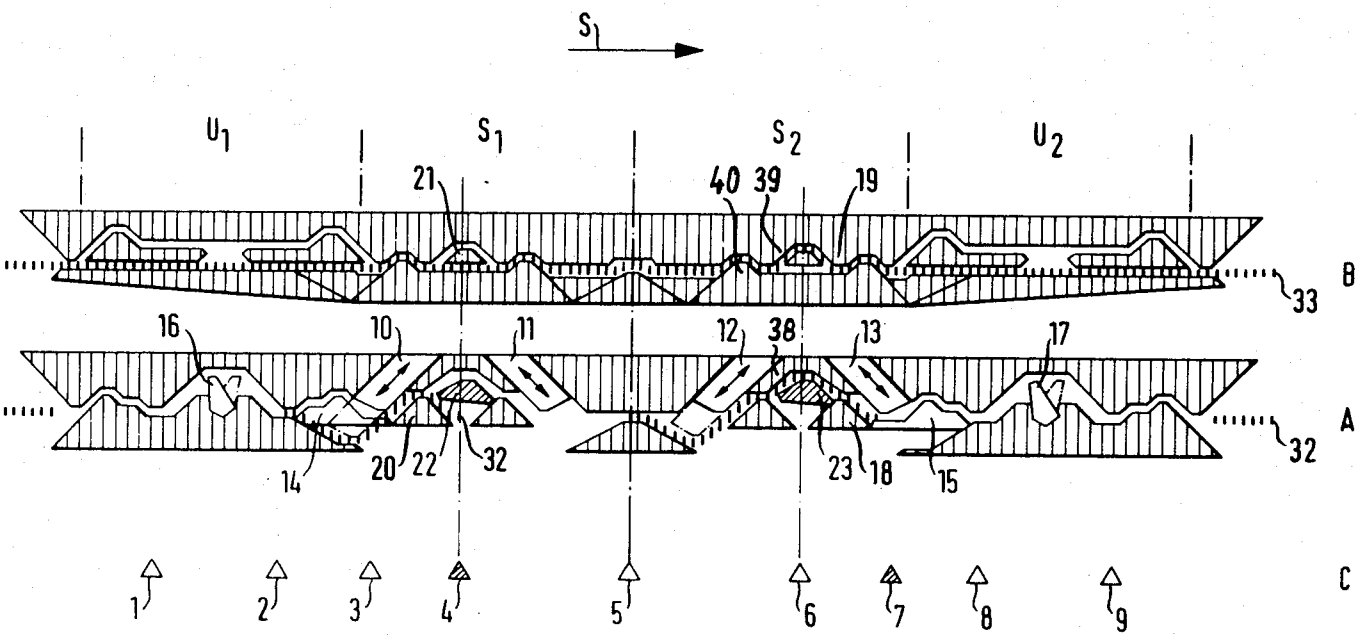
FIG. 2 shows the knitting and transfer cam unit combination of FIG. 1 displaced for the formation of stitches and the formation of tuck loops.

FIG. 2 shows the displaced position of the cam elements, leading for the formation of stitches and trailing for the formation of tuck loops, with a traverse of the carriage from left to right in the direction of the arrow S. The slider butts 33 always remain in operation, while the needle butts 32 are lifted out of the needle bed at the operative selection position 7. A stationary cam element 18 in the knitting cam unit strikes the needle butts 32 and forces them upwards, in combination with the action of the cam element 23 which is tilted into action, while the slider butts 33 are held by a stationary cam element 19 in the knitting cam unit until the needle hook is opened. Thereafter, the sliders are brought automatically by the needle bodies to their full extension. In this position the slider needle waits until, without relative movement between needle body and slider, it is retracted by cam elements 38 and 39 into the thread-laying position. A cam element 40 then extends the slider to a certain degree, while the triangular retractor 12 draws the needle body back. At the end of this relative movement, i.e. when the needle hook has again been closed, the needle body and slider slide downwards corresponding to the set retraction depth of the triangular retractor 12 and the newly laid thread is formed into the new stitch.

At selection position 4, in the trailing knitting cam unit, those particular slider needles which are to be used to form the tuck loops are chosen. A stationary cam element 20 extends the slider needles by means of their needle butts 32, while a stationary cam element 21 holds the sliders back by their slider butts 33 until the needle hooks are open.

All further movements follow as in the formation of stitches, but with the difference that the newly laid thread and the old stitch lie jointly in the needle hook and the newly laid thread, upon needle withdrawal to the basic position, is formed into the new tuck loop.

Figure 3:
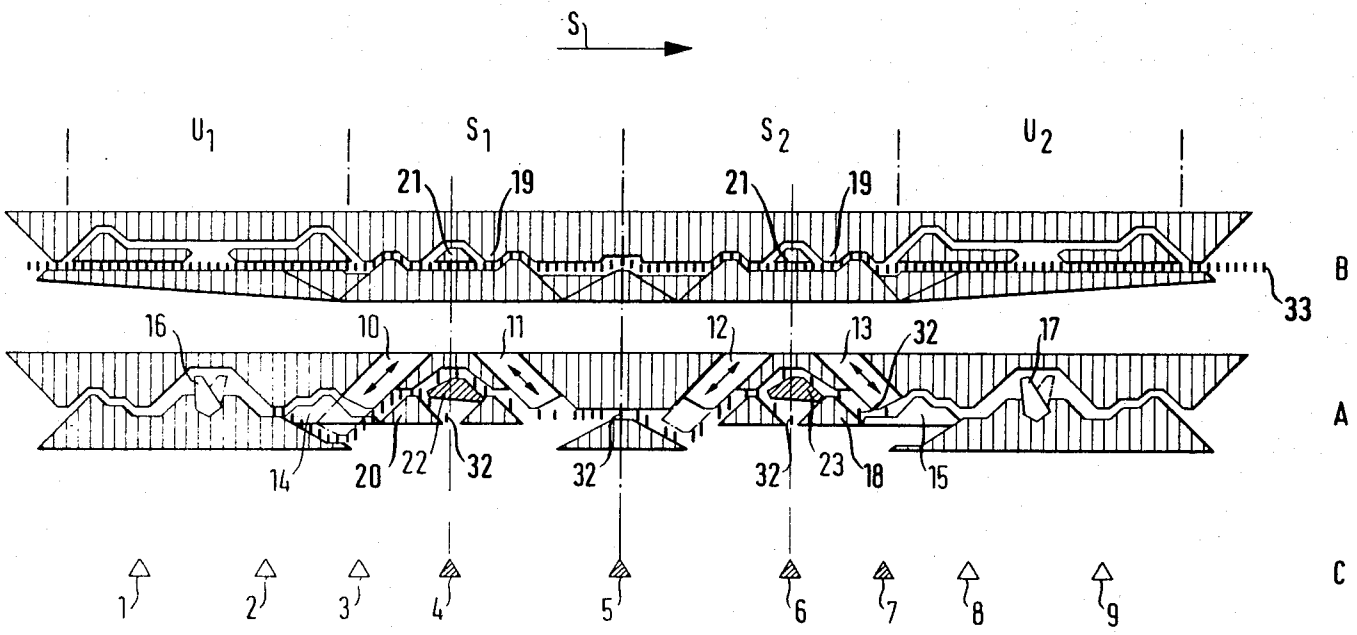
FIG. 3 shows the knitting and transfer cam unit combination of FIG. 1, displaced for knitting in the three-way technique (stitch, tuck, no-knit)

FIG. 3 shows the displaced position of the cam elements for knitting in the three-way technique with a traverse of the carriage from left to right in the direction of the arrow S. Any choice can be made here in respect of the two knitting cam units. Thus, in the leading cam unit, the slider needles for the formation of stitches are chosen at selection position 7, and the slider needles for the formation of tuck loops are chosen at selection position 6. In the trailing cam unit, the slider needles for the formation of the stitches are chosen at selection position 5, and the slider needles for the formation of the tuck loops are chosen at selection position 4. Those slider needles which are not to knit remain in their basic positions in which the needle butts 32 remain lowered in the needle bed and cannot be engaged by the knitting cam units.

FIG. 4 shows the displaced positions of the cam elements of the transfer cam units within the front and rear needle beds $U_2$ and $U_2'$ respectively for the leading donation of stitches from front to rear and for the trailing donation of stitches from rear to front with traverse of the carriage from left to right in the direction of the arrow S. Here, the front slider needles which are to donate the stitches rearwardly are selected at selection position 9. Their needle butts 32 slide upwards on a stationary cam element 24. The corresponding slider butts 33 are held by a stationary cam element 25 until the needle head is opened and the slider is entrained automatically by the needle body. When the maximum extension is achieved, then the slider butts 33 slide in a channel 26 and are held by a stationary cam element 27 until the needle body is withdrawn again to the basic position by a stationary cam element 28. In this position, in which the needle butts 32 are again lowered in the needle bed, the front donating slider needles linger until the needle butts 32' of the rear slider needles have been chosen at selection position 8' and have been extended by a cam element 15', which has been moved into operation up to a first step 29' in this cam element. In this position the slider needles in the rear needle bed are interlaced with their needle hooks between the two slider webs of the sliders of the slider needles in the front needle bed. The accepting slider needles in the rear needle bed project beyond the front stitch which is to be donated, as is shown in FIG. 6.

Figure 7:
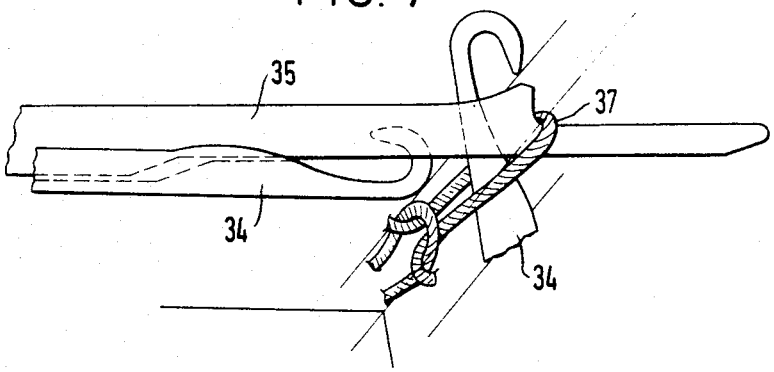

With further traverse of the carriage to the right the sliders in the front needle bed slide upwards on a fixed cam element 27 until the highest position is reached and the stitch to be donated is spread open and is displaced over the needle hook of the accepting slider needle in the rear needle bed, as is shown in FIG. 7. When this position is achieved, the slider needle in the rear needle bed is lifted by the cam element 15', moved into operation, and slides through the stitch, as is shown in FIG. 8. Trailing withdrawal surfaces 30 and 31' bring the sliders in the front needle bed as well as the slider needles in the rear needle bed back again to their basic positions. The stitch slides from the slider, which has earlier been retracted, and drops on to the needle hook of the rear slider needle.

In the trailing transfer cam unit in which transfer is made from the rear needle bed to the front needle bed, the donor slider needles in the rear needle bed are chosen at selection position 2' and the accepting slider needles in the front needle bed are chosen at selection position 1. For the rest, the functional procedure for the transfer is analagous to that described above in connection with the leading transfer cam unit. Since the cam channels for the needle butts and the slider butts are each symmetrical the respect to the central transverse axis of each transfer cam unit, it is possible to carry out the transfer in both directions of traverse of the carriage, as well as from the front rearwards and from the rear forwards. Knitting can also be performed during the transfer process.

Figure 5:
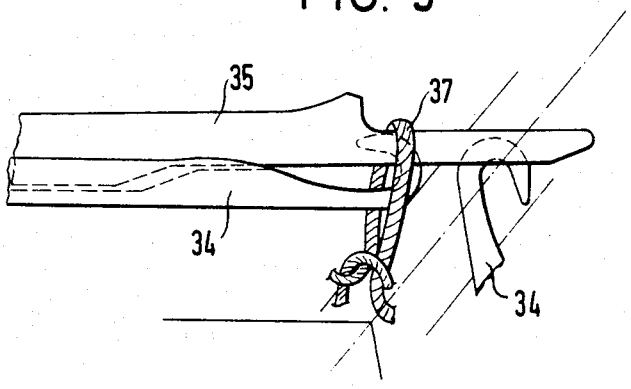
Figure 6:
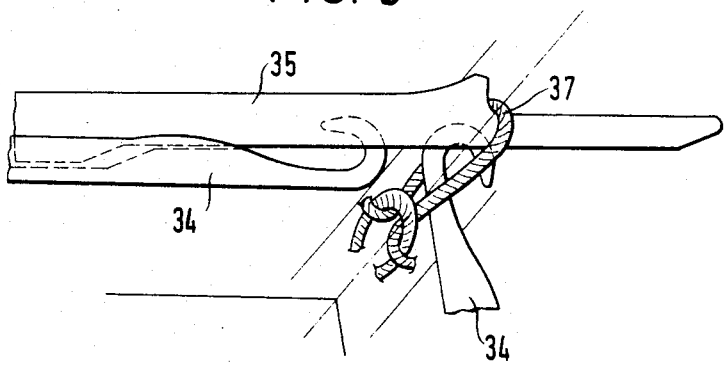

In FIGS. 5, 6 and 7 the needle body is indicated at 34, the slider at 35 and the stitch being transferred at 37. It is clearly apparent that during the donation of the stitch 37 the slider webs of the donating slider 35 are held spread apart without difficulty by the needle hook and the needle body 34 of the accepting slider needle.

We claim:

1. A knitting cam unit and transfer cam unit combination for V-bed flat knitting machines, wherein needle butts of the needle bodies of slider needles are selectively lowerable in the needle channels of the needle beds by means of a needle selection device wherein stationary and movable cam elements are provided for engagement with the needle butts and the slider butts, and wherein pressure cam elements are provided cooperating with the needle selection device, in which (a) at least one pure knitting cam unit and a leading and trailing pure transfer cam unit are provided, (b) cam channels for the needle butts and the slider butts are defined by the respective cam units, each channel being symmetrical with respect to the central transverse axis of each cam unit, (c) each knitting cam unit comprises a symmetrical cam element arranged to strike the needle butts for the formation of stitches, the or each said cam element being tiltable into operation in the leading sense at the positions of carriage reversal, (d) each transfer cam unit comprises a symmetrical cam element arranged to engage the needle butts for the donation of stitches and two cam elements arranged symmetrically with respect to said symmetrical cam element and arranged to engage the needle butts for the acceptance of stitches, wherein the cam elements adjacent to the respective knitting cam units, at the positions of carriage reversal, are movable out of operation when trailing the knitting cam unit and are movable into operation when leading the knitting cam unit, (e) for each knitting cam unit there are two selection positions for the needle butts for the formation of stitches, and, at the central transverse axis, one selection position for the needle butts for the formation of tuck loops, and (f) for each transfer cam unit there are two selection positions for the needle butts for the donation of stitches or for the acceptance of stitches.

2. A knitting cam unit and transfer cam unit combination according to claim 1, in which the cam elements which are arranged to engage the slider butts are stationary and are formed such that they define slider butt channels delimited on both sides for a relative movement between needle body and slider in the longitudinal direction of the slider.

3. A knitting cam unit and transfer cam unit combination according to claim 1 wherein the cam elements which are arranged to engage the needle butts for the donation of stitches are formed as elements pivotable by the needle butts.

4. A knitting cam unit and transfer cam unit combination according to claim 1 wherein two knitting cam units are arranged between the transfer cam units and in which one of the two selection positions for the needle butts for the formation of stitches is common to the two knitting cam units and is arranged between said knitting cam units.

5. A knitting cam unit and transfer cam unit combination according to claim 1 wherein a plurality of knitting cam units are also provided and a further transfer cam unit is arranged between adjacent knitting cam units.

* * * * *